United States Patent [19]

Beckmann et al.

[11] 4,111,489

[45] Sep. 5, 1978

[54] STACKED MINERAL MINING PLOWS INDEPENDENTLY DRIVEN OR COUPLED

[75] Inventors: Klaus Beckmann; Horst Linke, both of Lünen, Fed. Rep. of Germany

[73] Assignee: Gewerkschaft Eisenhutte Westfalia, Fed. Rep. of Germany

[21] Appl. No.: 789,407

[22] Filed: Apr. 21, 1977

[30] Foreign Application Priority Data

May 15, 1976 [DE] Fed. Rep. of Germany ..... 2621678

[51] Int. Cl.[2] ..... E21C 27/34

[52] U.S. Cl. ..... 299/34

[58] Field of Search ..... 299/32, 34, 43

[56] References Cited

U.S. PATENT DOCUMENTS 3,285,662 11/1966 Lobbe ..... 299/34

3,339,981 9/1967 Dommann et al. ..... 299/34

FOREIGN PATENT DOCUMENTS 1,458,701 10/1969 Fed. Rep. of Germany ..... 299/32

*Primary Examiner*—Ernest R. Purser

*Attorney, Agent, or Firm*—Charles E. Pfund

[57] ABSTRACT

A mineral mining installation employs a scraper-chain conveyor with a guide at the mineral-face side supporting a main machine, such as a plough, driven back-and-forth along a mineral face by a chain disposed at the mineral-face side of the conveyor. A further chain drive is arranged at the opposite side of the conveyor and is drivably coupled to an arm projecting over the conveyor and connecting with a further plough body. The further plough body is either supported together with the arm on further guides so that it can be driven back and forth along the face above the main machine or else the further plough body is supported directly on the main machine with its arm guided at the opposite side of the conveyor. Releasable coupling devices enable the further plough body to be connected to the main machine.

8 Claims, 3 Drawing Figures

STACKED MINERAL MINING PLOWS INDEPENDENTLY DRIVEN OR COUPLED

BACKGROUND TO THE INVENTION

The present invention relates to mineral mining installations.

It is known to construct a mineral mining installation from a scraper-chain conveyor which has a guide which slidably supports a winning or loading machine such as a plough. The machine is driven back and forth along the guide and along a mineral, e.g. coal, face by a chain mounted at the mineral face side of the conveyor. Installations are also known in which a second machine or plough is also driven along the conveyor with the aid of a second chain arranged at the stowage or goaf side of the conveyor. Such an installation is described in German Patent Specification No. 2,439,259 and here the second plough is connected to the second chain with the aid of a sword plate projecting beneath the conveyor. Both ploughs attack the face or seam over the same height region and since the ploughs travel along the same path they cannot pass one another. There is thus always the possibility that the ploughs will collide with one another. It is also known however, from German Patent Specification No. 1,208,269 to provide two ploughs which operate over different height regions of the face. The ploughs are driven respectively, by chains on the face and goaf sides of the conveyor and can pass one another to work the entire length of the face.

With regard to the foregoing a general object of this invention is to provide an improved installation.

SUMMARY OF THE INVENTION

In general a mineral mining installation made in accordance with the invention may comprise, as is known, a scraper-chain conveyor with a mineral removal, i.e., winning or loading, machine, guided for movement along the conveyor and driven by chain drive means at one side, i.e. the mineral face side, of the conveyor. In accordance with the invention a second chain drive means is arranged at the opposite side of the conveyor and means is provided for selectively connecting the machine to the second drive means. The means for selectively connecting the machine to the second chain drive means may take the form of, or include, an arm extending across the conveyor in gantry-like fashion and at least one releasable coupling device for connecting the arm to the machine.

In one embodiment of the invention a structure can be mountable onto the body of the machine and is coupled to the second chain drive means and means, such as at least one releasable device, serves to detachably connect the structure to the machine body. It is desirable to construct the structure as a further winning machine so that the two machines can be coupled together to form a composite machine working the entire height of the mineral face and driven by both chain drive means. Where the composite machine is operating the load forces can then be evenly distributed to both chain drives and this precludes undesirably high forces from becoming present in one chain drive. Alternatively by releasing the connection between the machine either the structure or machine can be removed or else both machines can operate independently over different height regions and can pass one another as is known per se. In addition to the main guide for the lower machine the installation preferably has additional guides for guiding the structure or the structure and the lower machine.

One form of installation made in accordance with the invention comprises a scraper-chain conveyor arranged alongside a mineral face, a first guide means at one side of the conveyor adjacent the mineral face, a first plough guided by said first guide means, a first chain drive means at said one side of the conveyor for driving the first plough back and forth along said first guide means, further guide means, a second plough guided by said further guide means, a second chain drive means at the opposite side of the conveyor for driving the second plough back and forth along the further guide means and along a path extending above the first plough and detachable means for selectively securing the first and second ploughs together.

Another form of installation made in accordance with the invention comprises a scraper-chain conveyor arranged alongside a mineral face, guide means at one side of the conveyor adjacent the mineral face, a plough guided by said first guide means, a first chain drive means at said one side of the conveyor for driving the first plough back and forth along said first guide means, a second chain drive means at the opposite side of the conveyor, a removable structure for mounting on the first plough and having a portion extending over the conveyor for connection with the second chain drive means and detachable means for releasably coupling the removable structure to said first plough.

The invention may be understood more readily, and various other features of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
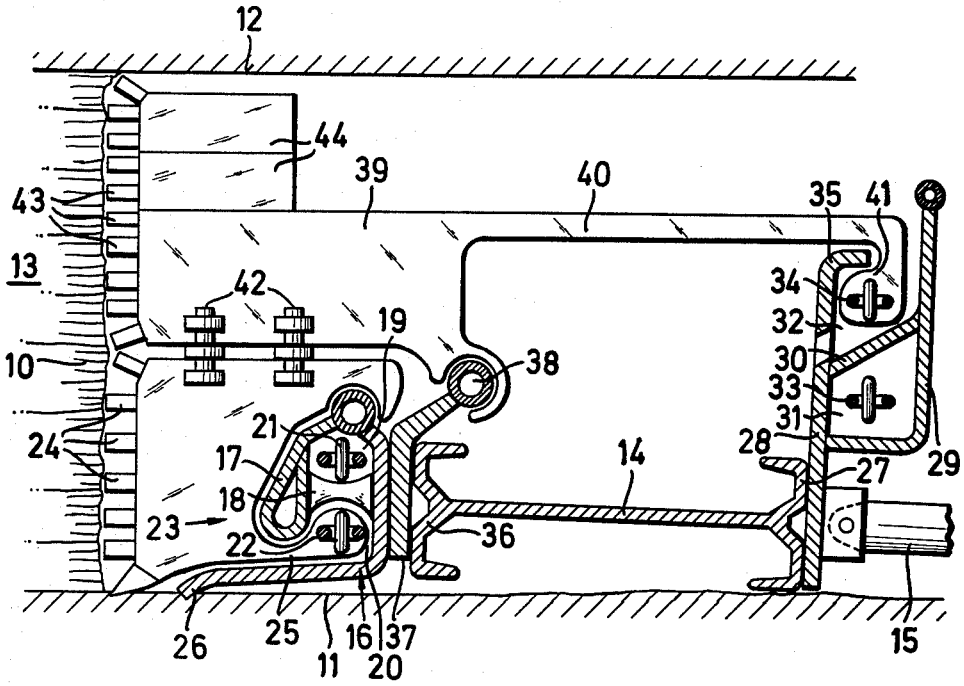
FIG. 1 is a schematic sectional end view of a mineral mining installation made in accordance with the invention.
Figure 3:
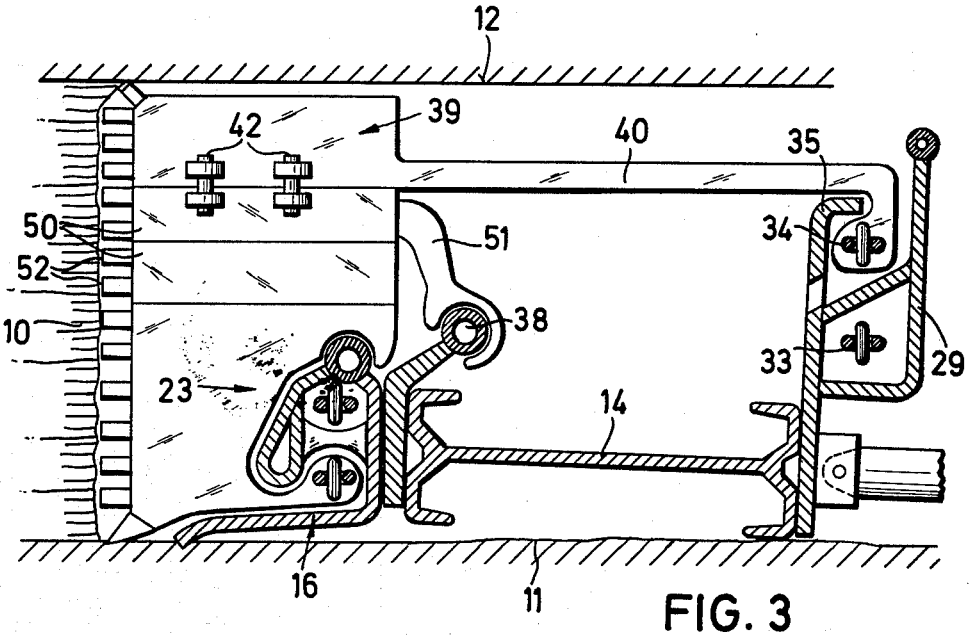
FIG. 3 is a schematic sectional end view of another mineral mining installation made in accordance with the invention.

As shown in FIGS. 1 and 3, a mineral mining installation is disposed in a mine working alongside a mineral seam 13 and more particularly a coal face 10. The floor and roof of the working are denoted 11 and 12, respectively. The installation employs a scraper-chain conveyor 14 of generally known design which is shifted up from time-to-time towards the face 10 with the aid of shifting rams 15. The conveyor 14 is itself composed of a series of channel sections or pans arranged end-to-end and interconnected to permit a slight degree of mobility in both horizontal and vertical senses therebetween. A scraper-chain assembly (not shown) is circulated along the channel sections to transport the mineral-bearing material therealong. The scraper-chain assembly is preferably driven by drive units arranged at both ends of the conveyor.

On the mineral-face side of the conveyor 14 there is a first guide in the form of an assembly 16. Bearing plates 37 are mounted between the guide assembly 16 and the side walls 36 of the channel sections of the conveyor 14 and these plates 37 carry a tubular guide 38. The guide assembly 16 is generally known per se, and has angle plates with upstanding portions pivotably supporting ramp-like cover plates 17 and foot portions with down-turned edges 26 engaging on the floor 11. Spacers 18 are mounted between the upstanding portions of the angle plates and the cover plates 17 to separate upper and lower chain guide passages 19, 20. A first mineral winning means or machine in the form of a plough 23 has a body which is supported for sliding by the guide assembly 16.

An endless drive chain for the plough 23 has an upper run 21 in the passage 19 and a lower run 22 in the passage 20. Cutters 24 adapted to strip mineral from the lower region of the face 10 are mounted on the body of the plough 23. The plough 23 is of the swordless type and the body thereof has one or more guide arms extending into the passage 20 and connected with the lower traction run 22 of the drive chain.

On the goaf or stowage side of the conveyor 14 a series of barrier plates 28 are mounted to the side walls 27 of the channel sections. The barrier plates 28 have flanges at their upper ends forming another guide 35. An assembly, composed of shaped plate structures 29, is mounted to the barrier plates 28 and has spacers 30 separating upper and lower chain guide passages 31, 32. A further endless drive chain has an upper traction run 34 in the passage 32 and a lower return run 33 in the passage 31.

A second mineral winning means or machine in the form of a plough 39 has a body located generally above the plough 23. The body of the plough 39 again has cutters 43 adapted to strip mineral from the upper region of the face 10. Cutter-mounting attachments can be mounted to the body of the plough 39 to ensure the plough 39 engages the entire upper region of the face 10 up to the roof level. The body of the plough 39 is guided by the guide 38 and has a gantry-like arm 40 projecting across the conveyor 14. The arm 40 is guided by the guide 35 and has guide blocks 41 engaging in the passage 32 and connected with the chain run 34.

As shown in FIG. 1, the ploughs 23, 39 can be detachably connected with coupling or connection devices 42 to form a composite mineral winning machine driven by both the chains 21, 22 and 33, 34. In this case the composite machine 23, 39 is guided at the lower part by the assembly 16 and at the upper part by the guides 35, 38. The drive means propelling the chains 21, 22, and 33, 34 may be designed to distribute the load equally between the chains. To this end hydraulic motors which have a hydraulic load compensating system can be utilized.

Where the mineral is comparatively easy to win and the traction forces on the chains are moderate the machine 23, 39 can be driven by one of the chains, e.g. 21, 22 and the other chain, e.g. 33, 34 would then be disconnected. It is thus desirable to have detachable couplings between the chains 21, 22 and 33, 34 and the machine 23, 39.

Figure 2:
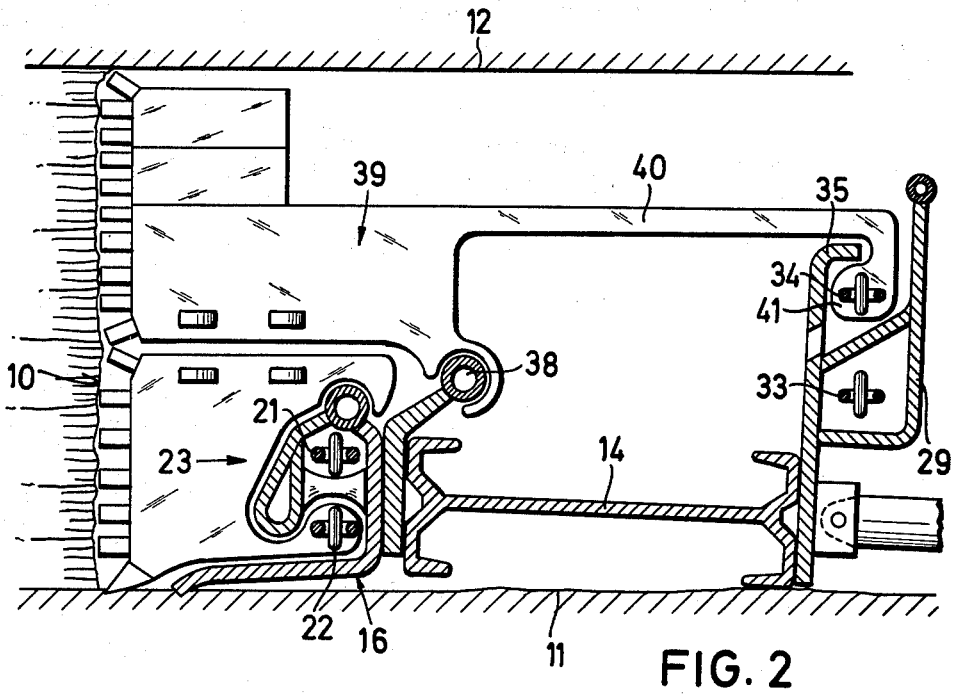
FIG. 2 is a view of the installation corresponding to FIG. 1 but showing the machines or ploughs separated from one another.

As shown in FIG. 2, by detaching the coupling devices 42 the ploughs 23, 39 can become separated from one another and in this case the ploughs 23, 39 can be operated entirely independently. The ploughs 23, 39 can move past one another and thus each plough 23, 39 can be driven by its chain 21, 22, 33, 34 along the entire length of the working.

In the modified installation represented in FIG. 3, the height of the body of the main plough 23 is increased by means of an attachment or super structure 50 detachably secured to the main body of the plough 23. The super-structure 50 is provided with one or more guide arms 51 which engage on the guide 38 and with cutters 52.

The super-structure 50 directly supports a body or structure forming the other plough 39 which is here guided solely by the guide 35. The plough 39 is either coupled with the plough 23 with the devices 42 to form the composite machine as described hereinbefore or alternatively the plough 39 is removed by releasing the devices 42 and then the plough 23 is operated on its own.

An installation constructed in accordance with the invention enables maximum productivity to be achieved while permitting the installation to be readily changed to cope with a variety of operating-conditions.

We claim:

1. A mineral mining installation comprising a scraper-chain conveyor arranged alongside a mineral face, ramp-like guide means arranged at one side of the conveyor adjacent the mineral face, a main floor plough guided by said guide means for movement along the conveyor, chain drive means for driving the main plough, further guide means at the mineral face side of the conveyor and disposed nearer the center of the conveyor than the ramp-like guide means, a plough structure mounted on the main plough and separately guided with the further guide means and detachable coupling means for connecting the plough structure to the main plough.

2. A mineral mining installation comprising a scraper-chain conveyor arranged alongside a mineral face, a first guide with a ramp-like profile provided at the mineral face side of the conveyor, a tubular guide carried by angle-plates extending between the first guide and the conveyor, the tubular guide being disposed above the first guide and offset towards the center of the conveyor in relation to the first guide and a multiple plough structure for stripping mineral from said mineral face, said plough structure being composed of a main floor plough equipped with mineral cutters guided directly by the first guide, a plough body equipped with mineral cutters mounted onto the main plough and having a portion engaging with and guided by the tubular guide and releasable connecting means joining the plough body to the main plough.

3. A mineral mining installation comprising a scraper-chain conveyor arranged alongside a mineral face, a guide at one side of said conveyor adjacent the mineral face, a plough guided by said guide for movement along the conveyor, a first chain drive means for driving the plough along the conveyor, said first chain drive means being disposed at said one side of the conveyor, a second chain drive means arranged at the side of the conveyor opposite said first chain drive means, further guide means, a further plough connected to the second chain drive means and guided for movement along the conveyor by said further guide means and at least one releasable device operable to join the ploughs together with the further plough on the first-mentioned plough to form a composite winning machine driven by both the first and second chain drive means, wherein the releasable device can be removed to permit the ploughs to operate independently, the first-mentioned plough being driven by said first chain drive means to win mineral from a lower floor region of the mineral face and the further plough being driven by said second chain drive means to pass above the first-mentioned plough and win mineral from an upper region of the mineral face.

4. An installation according to claim 3, wherein a further guide is provided at said one side of the conveyor and said plough carries a super-structure which engages with said further guide and which is equipped with mineral cutters.

5. An installation according to claim 4 wherein said second plough comprises a removable body equipped with mineral cutters and supported by the super structure and an arm extending over the conveyor for connection with said second chain drive means and the releasable device serves for connecting the body to the super structure.

6. A mineral mining installation comprising a scraper-chain conveyor arranged alongside a mineral face, a first ramp-like guide means at one side of the conveyor adjacent the mineral face, a main plough guided by said first guide means, a first chain drive means at said one side of the conveyor for driving the first plough back and forth along said first guide means, further guide means provided at said one side of the conveyor, a second plough guided by said further guide means and located above the main plough, a second chain drive means at the opposite side of the conveyor for driving the second plough back and forth along the further guide means and along a path extending directly above the first plough and detachable means for selectively securing the first and second ploughs together.

7. An installation according to claim 6 wherein another guide is provided at the opposite side of the conveyor for guiding said second plough.

8. A mineral mining installation comprising a scraper-chain conveyor arranged alongside a mineral face, first guide means at one side of the conveyor adjacent the mineral face, a main plough guided by said first guide means, a first chain drive means at said one side of the conveyor for driving the first plough back and forth along said first guide means, a second guide means at said one side of the conveyor, a second chain drive means at the opposite side of the conveyor, third guide means at said opposite side of the conveyor, a second plough with a body directly above the first plough, the second plough being guided by the second and third guide means and having a portion extending over the conveyor for connection with the second chain drive means and detachable means for releasably coupling the second plough to said first plough.

* * * * *